United States Patent [19]

Colby

[11] Patent Number: 4,579,383

[45] Date of Patent: Apr. 1, 1986

[54] FOLDABLE FURNITURE PRODUCT

[75] Inventor: Donald B. Colby, Sarasota, Fla.

[73] Assignee: Lee L. Woodard, Inc., Owosso, Mich.

[21] Appl. No.: 607,807

[22] Filed: May 7, 1984

[51] Int. Cl.[4] ..... A47C 4/28

[52] U.S. Cl. ..... 297/45; 297/441

[58] Field of Search ..... 297/45, 44, 42, 441

[56] References Cited

U.S. PATENT DOCUMENTS

| | | | |
|---|---|---|---|
| 1,580,557 | 4/1926 | McGrew | 297/45 |
| 2,447,391 | 8/1948 | Brandes et al. | 297/45 |
| 2,601,379 | 6/1952 | Everest et al. | 297/45 X |
| 2,620,859 | 12/1952 | Kundtz et al. | 297/45 |
| 2,837,142 | 6/1958 | McGuire | 297/45 |
| 2,930,429 | 3/1960 | Mize | 297/45 |
| 4,105,244 | 8/1978 | Colby | 297/45 |
| 4,269,532 | 5/1981 | Sorrentino | 403/233 X |
| 4,320,818 | 3/1982 | Knoche | 297/45 |

FOREIGN PATENT DOCUMENTS

| | | | |
|---|---|---|---|
| 3730 | of 1926 | Australia | 297/45 |

*Primary Examiner*—Francis K. Zugel

*Attorney, Agent, or Firm*—Learman & McCulloch

[57] ABSTRACT

A foldable, lightweight, principally metal chair or ottoman has a pair of spaced apart side frames with front and rear legs connected by an upper arm. The seat comprising a pair of fore to aft extending seat side rails, each lying within the vertical plane of one of the side frames, and connected together by a flexible material seat web is supported for folding movement by a pair of vertically inclined cross frames pivotally connected generally intermediate their ends and fixed at their upper ends to the seat side rails. Each cross frame is pivotally connected to a side frame near the lower end thereof, and caps on the seat side rails have forwardly and rearwardly extending extensions which project beyond the seat rails to engage the inboard sides of the front and rear legs of the side frames when the furniture unit is unfolded to spread position to react to the weight of a seat occupant and bear against the legs to maintain them in spread apart position.

8 Claims, 10 Drawing Figures

FOLDABLE FURNITURE PRODUCT

The present invention relates to foldable, lightweight metal furniture products of the type which are employed as outside furniture on patios and around swimming pools and the like, for example, or as inside furniture.

BACKGROUND OF THE INVENTION

Specifically, the product may comprise a chair or ottoman and the present invention is concerned with foldable units of the general type disclosed in U.S. Pat. Nos. 4,105,244; 4,269,532; 4,325,577; 4,359,244; 1,676,074; 1,856,759; 1,882,585; 1,925,246; 2,581,793; 2,582,864; 2,837,142; 2,914,111; and 3,711,151.

For the sake of providing an attractive chair which is foldable, and yet sturdy and rigid when in spread position, certain parameters were predetermined which needed to be observed in the design of the present furniture unit. The first of these was that the support legs were to have no bottom runners. A second parameter was that the seat side rails were to be disposed in the vertical plane of the inversely U-shaped side frames when the chair or ottoman was in folded down position. Another requirement for the chair units was that the arm rest portions of the frames pivotally support a back rest which was pivotal to a horizontal position so that the chair could be folded.

Still another parameter considered necessary was the requirement that the chair or ottoman seat be of ample width and have an angle in its normal position which provided at least an inch of differential level in the vertical direction for a person sitting in the seat. Another requirement was the provision of compact unitary braces for each of the pivotally joined vertically inclined cross frames to connect them with the seat side rails and the side frames, and still a further requirement was for cap members for the ends of the seat rails to cover the cavities in the seat rails within which the transverse welt edges of the flexible seat were removably secured. With the seat rails situated in the plane of the side frames, another design parameter involved providing structure for rigidifying the furniture unit when the product was unfolded to spread position by reacting to the weight of a seat occupant to bear against the side frame legs and maintain them in spread apart position.

SUMMARY OF THE INVENTION

With the foregoing in mind, one of the prime objects of the present invention is to provide a unit which observes the parameters mentioned, is extremely attractive in appearance, and is economical to manufacture and market.

Still another object of the invention is to provide a foldable furniture product which can be constructed of lightweight aluminum components, and yet is structurally sound and does not look like the usual folding furniture.

Still another object of the invention is to provide a product of the character described wherein the seat is capable of forward movement during the unfolding of the side frames to the extent required by the back rest connection between the side frames, and the understructure for the seat is so constructed that visibly telescoping parts are not a necessary part of the structure.

Still a final object of the invention is to provide a foldable furniture construction of reliable construction which provides the required lateral stability and avoids the creation of localized high stress areas which result in early failure of the parts, and a consequent short useful life of the unit.

The present invention provides a seat comprising a pair of fore to aft extending side rails, each lying within the vertical plane of one of the side frames and connected together by a flexible material web. Vertically inclined cross members, pivotally connected intermediate their ends are welded at their upper ends to the seat side rails, and feet are provided on these cross members, in the plane of each of the side frames, which pivotally connect to the front and rear legs of a side frame near the lower end thereof. In the product which is depicted, plastic cap members slip over the ends of the seat rails to cover the welt edge accommodating cavities therein, and these caps have forwardly and rearwardly extending projections at the inner extremities thereof which project beyond the seat rails to engage the inboard sides of the front and rear legs of the side frames when the furniture product is unfolded to spread position to react to the weight of a seat occupant in a manner to maintain the lateral stability of the unfolded furniture product.

IN THE DRAWINGS

DESCRIPTION OF A PREFERRED EMBODIMENT

Figure 2:
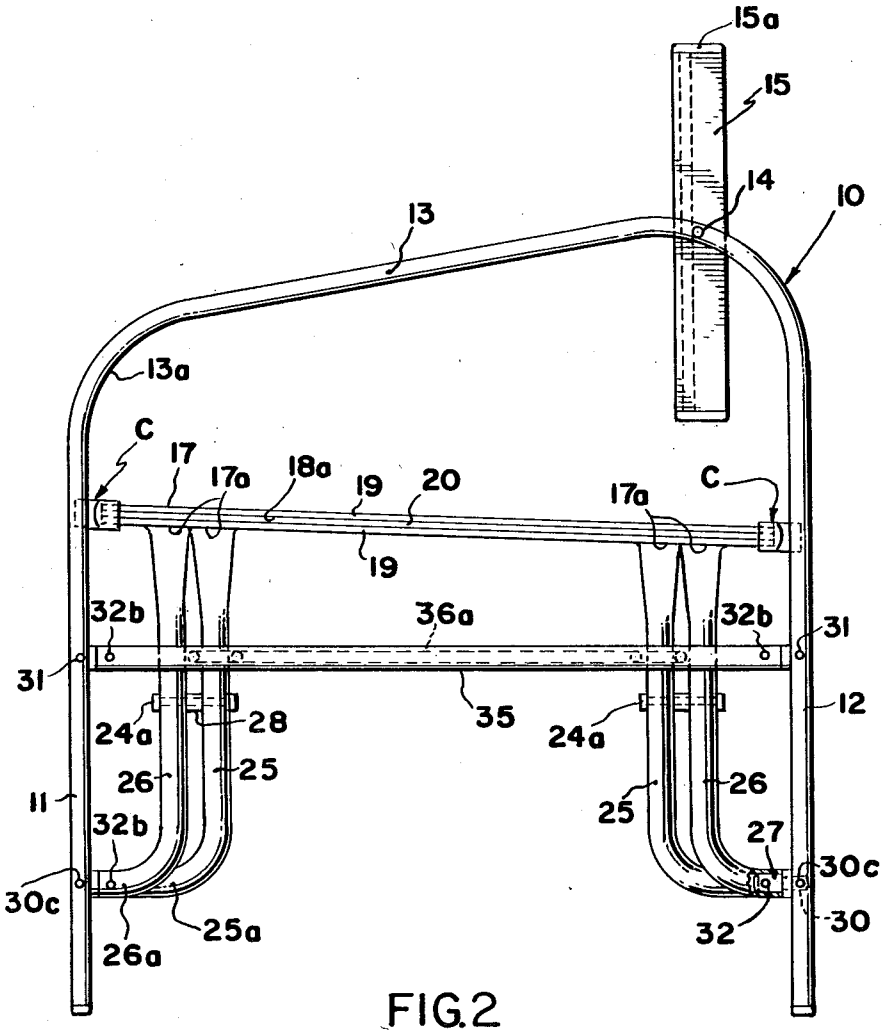
FIG. 2 is a side elevational view thereof.

A preferred, foldable furniture product is illustrated in the drawings as a chair which comprises a pair of vertically disposed, inversely U-shaped aluminum side frames generally designated 10, each comprising front legs 11 and rear legs 12 connected by a vertically inclined sloping arm rest 13. Mounted on pivotal rivet members 14, supported by the arm rest portions 13 near their rear ends, are the side rails 15 of a back or back rest generally designated B which comprises the side rails 15 and a taut fabric strip 16 having its welt edges connected within the tubular side members 15. End caps 15*a* cover the ends of the rails 15.

Figure 6:
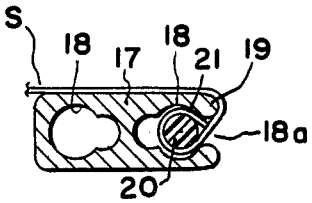
FIG. 6 is a sectional elevational view taken on the line 6—6 of FIG. 5.

It is to be observed that the chair is provided with a seat generally designated S which includes tubular aluminum side rails 17 which, when the seat is in operative, weight supporting position, are disposed within the vertical planes of the side frame members 10. These tubular fore and aft extending seat side frames 17 are configured as shown in FIG. 6 with a pair of keyhole shaped openings 18, the outermost opening 18 being provided with a gap 18*a* between overlying bead edges 19. Preferably plastic, fore and aft extending rods 20 of greater diameter than the gap 18*a*, are provided in each opening 18 by slipping them endwisely through the welts 21, which are formed in the edge portions of the fabric seat S.

Figure 4:
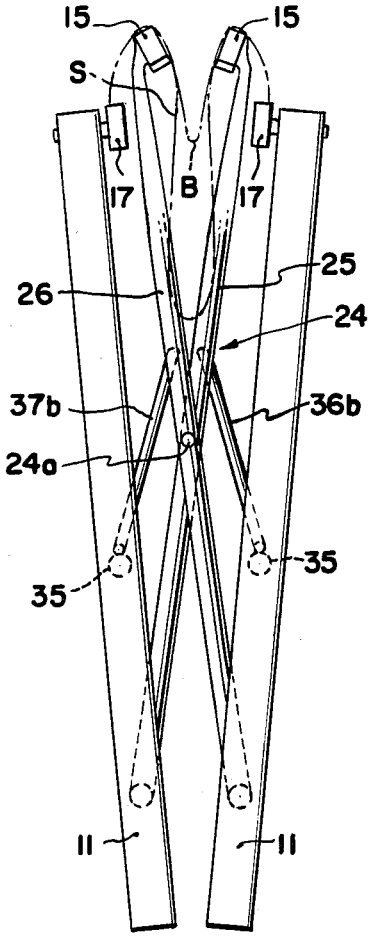
FIG. 4 is a front elevational view showing the chair in folded position for transport or storage.
Figure 5:
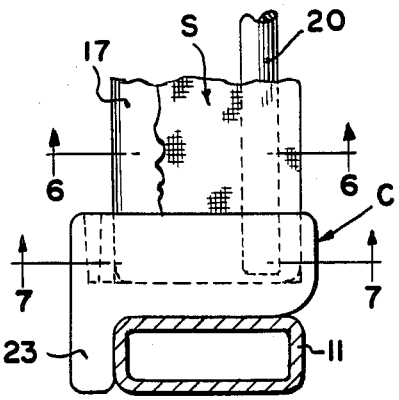
FIG. 5 is an enlarged view of the circled 5—5 structure in FIG. 3.
Figure 7:
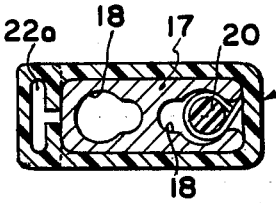
FIG. 7 is a similar sectional view taken on the line 7—7 of FIG. 5.
Figure 8:
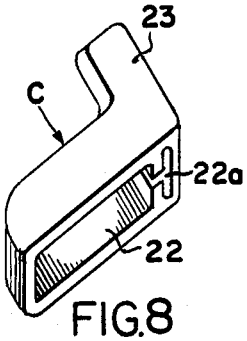
FIG. 8 is a perspective plan-elevational view of the end cap which is employed.

A preferably plastic end cap, generally designated C, which is particularly shown in FIG. 8, has an opening 22 sized to be pressure fitted over the ends of each rail 17 in the manner indicated in FIG. 7, there being a key-shaped slot portion 22*a* associated with the end cap C as shown which permits any deformability required. Each cap C, at its inner extremity, has an extension 23 which, as FIG. 5 clearly discloses, projects to lie laterally adjacent the legs 11 and 12 on each side of the chair when the chair is in unfolded, occupant-supporting position. Provided to support the side frames 10 in a manner to permit the chair to fold to the position shown in FIG. 4, are a pair of fore and aft scissors frames, generally designated 24, which each comprise inner and outer members 25 and 26, respectively, pivotally connected intermediate their ends by a rivet 27. A spacer 28 may be provided on each of the rivet pins 27, as shown in FIG. 2.

Figure 9:
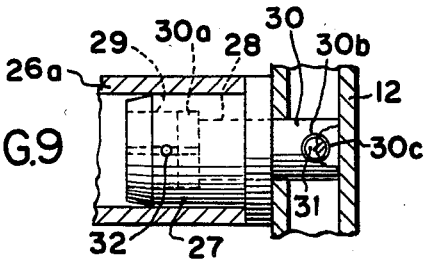
FIG. 9 is an enlarged sectional elevational view illustrating the manner in which the cross brace feet and the brace shaft ends are connected to the chair legs.

At their upper ends, the members 25 and 26 are welded to the seat side rails 17 as at 17*a*. At their lower ends, the members 25 and 26 have foot portions 25*a* and 26*a* which extend in a fore or aft direction to the legs 11 and 12 as shown. A suitable construction of the joint connecting feet members 25*a* and 26*a* to legs 11 and 12 is illustrated in FIG. 9 particularly, but may vary in structure. As shown it comprises a tubular bushing or sleeve, generally designated B having a bore 29*a;* and a counterbore 29, the bore 28 receiving a pivot pin 30 and the counterbore receiving the enlarged head 30*a* of the pivot pin 30. The pivot pin 30 of each joint is fixed to the legs 11 or 12 by way of a pin 31 extending through an opening 30*b* in the pin 30 and openings 30*c* in the legs 11 and 12. Bushings B are fixed to the feet 25*a* and 26*a* by way of pins 32 extending through openings 32*a* provided in bushings 27 and openings 32*b* provided in the feet 25*a* and 26*a*. Of course, pin 30 is freely rotatable in the bore 29*a*. A nib 33 may be provided in each bushing B for reception within a groove 34 provided in pin end portion 30*a* so that opening 30*b* is located precisely when the parts are assembled with respect to the like openings 30*c* provided in the front and rear legs 11 and 12 for reception of the pins 31. When the chair is initially folded, nibs 33 will break off with relative rotation of the parts B and 30. The parts B and 30 may preferably be formed of plastic.

Figure 3:
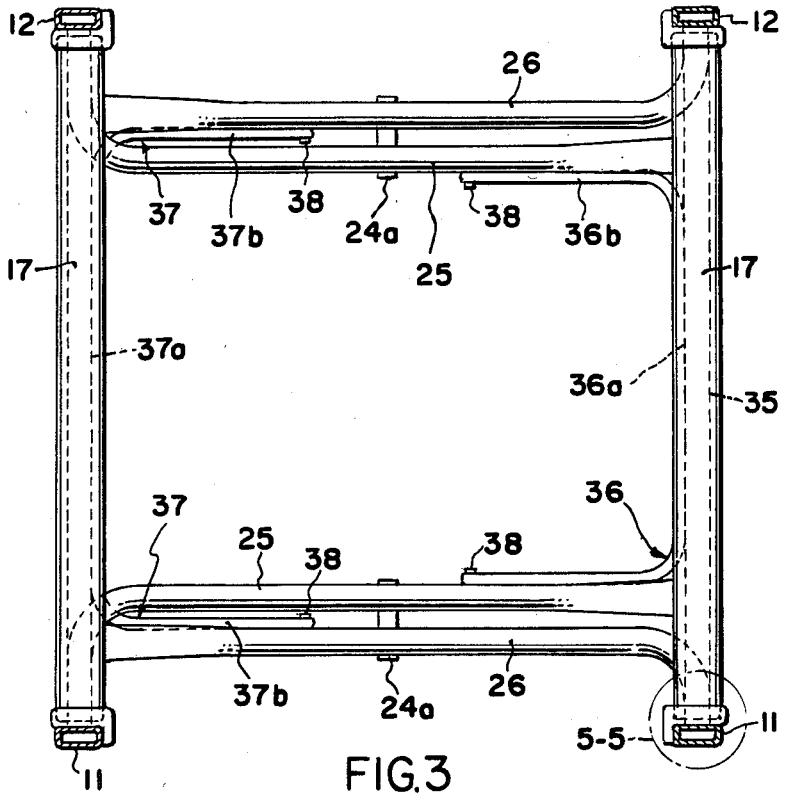
FIG. 3 is a sectional top plan view taken on the lines 3—3 of FIG. 1.
Figure 10:
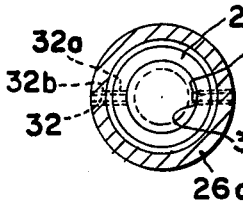
FIG. 10 is an end elevational view of the rotary joint which is employed.

The internal, hidden rotary joint construction disclosed in FIGS. 9 and 10 is also employed at the ends of shafts 35 which extend in a fore and aft direction and connect the U-shaped braces 36 and 37 to the legs 11 and 12. This description, therefore, will not be repeated. Welded to the shafts 35 at their mid-sections are the mid-sections 36*a* and 37*a* of braces 36 and 37 which have legs 36*b* and 37*b*, respectively. The legs 36*b* are pivotally connected as with pins 38 to the cross brace members 25, as indicated in FIG. 3. The mid-portion of the brace 37 which connects to the outer members 26 is, as noted, greater in extent than the mid-portion of the brace 36.

THE OPERATION

Figure 1:
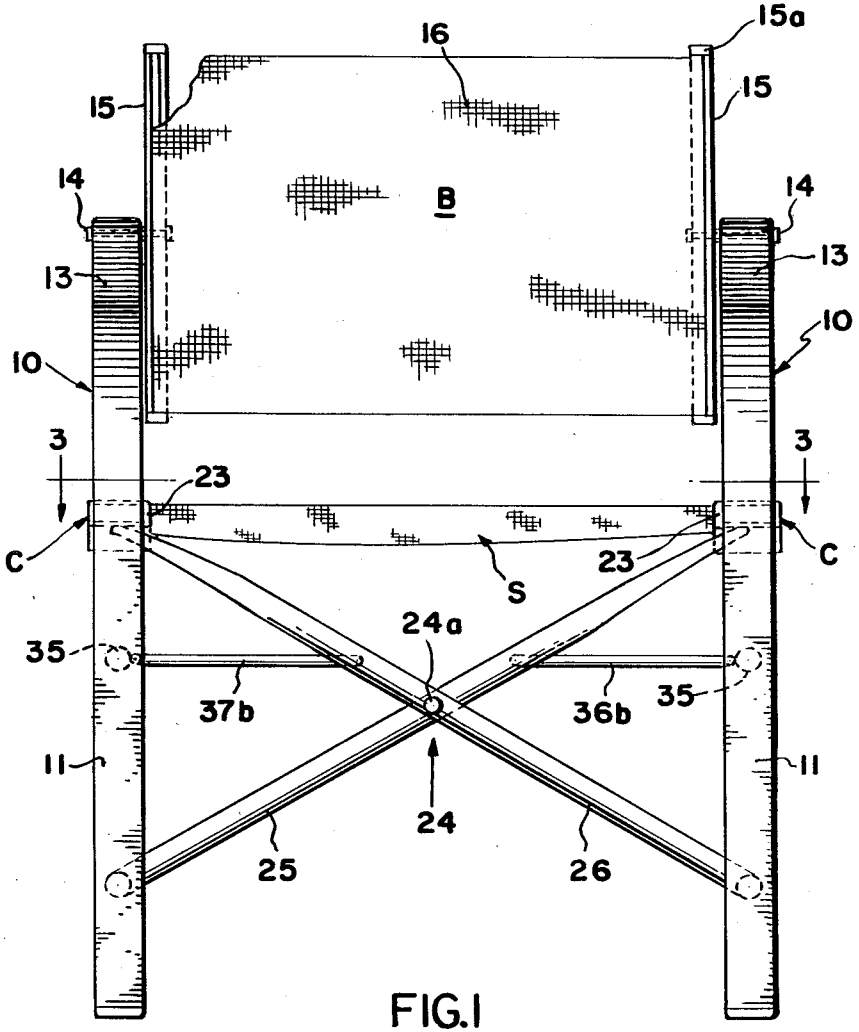
FIG. 1 is a front elevational view of a chair which embodies the invention in spread apart operative position.

Assuming the chair is in the folded position shown in FIG. 4, the unfolding of the chair involves some forward movement of seat S due to the requirement for tautness in the back rest B which connects the upper rear portions of side frames 10. This forward shifting occurs until the front caps C contact the front curvatures 13*a* of arm rest portions 13 whence the seat side rails 17 are cammed rearwardly to the positions shown in FIG. 3. The back rest 16 assumes a taut tensioned position before the seat is fully in the FIG. 1 position and causes the forward shift of seat S.

During the unfolding operation, the shafts 35 not only brace the side frames 10 but rotate in the legs 11 and 12, and the feet portions 25*a* and 26*a* of the braces 25 and 26 simultaneously rotate in the legs 11 and 12. The rotation of the parts B and 29*a* provide "internal pivots" for both the ends 25*a*,26*a* and the shafts 35.

In the FIG. 4 position the back B is in a horizontal mode in which the rails 15 are substantially horizontal. The initial step in folding the chair involves tilting of the back B to a substantially horizontal position. The seat side rails 17 can then be lifted and the frames 10 moved toward one another.

While one embodiment of the invention has been described in detail, it will be apparent to those skilled in the art that the disclosed embodiments may be modified. Therefore, the foregoing description in all aspects is to be considered exemplary rather than limiting in any way, and the true scope of the invention is that defined in the following claims.

I claim:

1. In a lightweight foldable, substantially metal, furniture product, such as a chair or ottoman; a pair of transversely spaced apart, generally inversely U-shaped side frames, each disposed in a generally vertical plane and having front and rear legs connected by an upper arm; a seat comprising a pair of fore to aft extending seat rails, each lying within the vertical plane of one of said side frames, and connected together by a flexible material web; a pair of cross frames comprising vertically inclined members pivotally connected generally intermediate their ends, and fixed at their upper ends to said seat side rails; one cross frame member of each pair at its lower end being pivotally connected to the front leg of a side frame near the lower end thereof, and the other cross frame member of each pair at its lower end being pivotally connected to the rear leg of a side frame near the lower end thereof; forwardly and rearwardly extending projections on said seat side rails at the inner extremities thereof projecting to engage inboard sides of the respective front and rear legs of said side frames when the furniture product is unfolded to spread position to react to the weight of a seat occupant and bear against the legs to maintain them in spread apart position; laterally extending brace members pivotally connected to the cross frames, and also pivotally connected to said front and rear legs of the side frames; a shaft spanning the front and rear legs of each side frame mounted for pivotal rotation with respect to each about its axis; said brace members being U-shaped in plan view, and having their mid-portions extending parallel to and adjacent said shafts, and welded thereto.

2. In a foldable lightweight metal furniture product, such as a chair or ottoman; a pair of transversely spaced apart, side frames each disposed in a generally vertical plane and having front and rear legs connected by an upper arm; a seat comprising a pair of fore to aft extending seat side rails, each lying within the vertical plane of one of said side frames and connected together by a flexible material web; a pair of cross frames, comprising vertically inclined members pivotally connected generally intermediate their ends and fixed at their upper ends to said seat side rails, one cross frame member of each pair at its lower end being provided with a forwardly projecting independent foot having a generally horizontal axis lying generally in the vertical plane of one of said side frames and being pivotally connected to the front leg of a side frame near the lower end thereof for rotation about said foot axis, the other cross frame member of each pair at its lower end being provided with a rearwardly projecting independent foot having a generally horizontally extending axis lying generally in the vertical plane of one of said side members, and being pivotally connected to the rear leg of a side frame near the lower end thereof for rotation about said foot axis, a shaft spanning the front and rear legs of each side frame mounted for pivotal rotation with respect to each about its axis, brace members each having a web attached to one of said shafts and projecting legs attached to said cross frame members, to connect the pair of cross frames; and forwardly and rearwardly extending projections on said seat side rails at the inner extremities thereof projecting to engage the inboard sides of the respective front and rear legs of said side frames when the furniture product is unfolded to spread position to react to the weight of a seat occupant and bear against the legs to maintain them in spread apart position.

3. The product of claim 2 in which said brace members are U-shaped in plan view, and have their mid-portions extending parallel to and adjacent said shafts, and welded thereto.

4. The product of claim 2 in which axially aligned bearings are provided in said front and rear legs to receive said feet for pivotal rotation.

5. The product of claim 4 in which a sleeve is provided on the end of each foot section and a pin is provided in each leg to be received thereby for relative rotary movement.

6. The product of claim 2 in which axially aligned bearing openings are provided in said front and rear legs of the frame, an insert sleeve is provided on the end of each shaft, and a plastic bushing is provided in each such bearing opening connected with said legs to receive said sleeve insert for rotary movement.

7. The product of claim 2 in which a generally vertical flexible back member of less width than the seat web and relatively taut when the product is in unfolded position is pivotally mounted intermediate its upper and lower edges on the rear portions of said side frame, and is pivotal to a generally horizontal position.

8. The product of claim 2 in which said projections extend in a fore and aft direction from end caps fitted over the ends of the seat rails to cover the welt edges of the seat fabric which are received therein.

* * * * *